United States Patent [19]

Heilner

[11] Patent Number: 4,905,329

[45] Date of Patent: Mar. 6, 1990

[54] INFLATABLE SUPPORT FOR AIDING A PATIENT TO RISE FROM A SEATED POSITION

[76] Inventor: Helmut Heilner, 136 Big Oak Rd., Stamford, Conn. 06903

[21] Appl. No.: 417,269

[22] Filed: Oct. 5, 1989

[51] Int. Cl.[4] ..... A47C 7/00

[52] U.S. Cl. ..... 5/431; 5/441; 5/453; 297/284; 297/DIG. 3; 297/DIG. 10

[58] Field of Search ..... 5/431, 441, 449, 453, 5/455, 456, 433, 446; 297/313, 284, 339, DIG. 3, DIG. 10

[56] References Cited

U.S. PATENT DOCUMENTS

| | | | |
|---|---|---|---|
| 3,479,087 | 11/1969 | Burke | 297/DIG. 10 |
| 3,659,897 | 5/1972 | Wright | 297/DIG. 10 X |
| 3,795,021 | 3/1974 | Moniot | 5/441 |
| 4,005,498 | 2/1977 | Starr et al. | 5/455 X |
| 4,592,589 | 6/1986 | Hellwig | 297/284 |
| 4,688,851 | 8/1987 | Whiteford | 297/DIG. 10 X |

*Primary Examiner*—Michael F. Trettel
*Attorney, Agent, or Firm*—Parmelee, Bollinger & Bramblett

[57] ABSTRACT

An inflatable seat cushion is positioned on a firm support on which a user is seated for assisting the user in rising from a seated position. The cushion is in the form of a ring-shaped inflatable tube having a front and rear area in which the front area is restricted during inflation with respect to the rear area. The ratio of inflation being between the rear and front areas is in the range of three to seven times greater. The inflatable cushion is inflated under the control of the user or attendant whereby the thighs of the user are supported and are elevated by the inflation of the front area of the cushion while the user's buttocks which is seated on the cushion is simultaneously elevated about 3–7 times higher than the user's thighs thereby raising the user slowly from a sitting to a standing position in front of the support in which the cushion is positioned. The cushion may be formed of two ring-shaped tubes which are inflated simultaneously but are bound together and restricted in inflation by a suitable cover or binding. The cushion may also be formed of a singlé tube which is tapered from front to rear which also may have a suitable restricting cover.

7 Claims, 3 Drawing Sheets

INFLATABLE SUPPORT FOR AIDING A PATIENT TO RISE FROM A SEATED POSITION

FIELD OF THE INVENTION

This invention relates to an inflatable seat cushion, and more particularly to such a cushion which is portable and may be placed on existing seats, beds or other supports in which the user is assisted in rising from a sitting to a standing position under control of the user or an attendant.

BACKGROUND OF THE INVENTION

There are a great number of handicapped or infirm people inflicted with advanced arthritis, multiple sclerosis or similar incapacitating diseases, strokes or various types of spinal injuries. Such people may have difficulty in rising from a sitting into a standing position without help or without the assistance of some specially built, expensive medical appliance apparatus. The aforesaid people are assumed, for purpose of the present invention, to be able to stand on their own feet or even walk with or without aid once they are standing.

Various types of devices have been proposed for shifting or moving the body of a patient in different positions. One device which has been used to assist aiding users to rise from a sitting position is a pneumatic lifter seat which is portable and rises to assist the user in leaving a chair. The problem with such a device is that the pneumatic cylinder which is used to elevate the cushion does so from the rear such that the user is lifted only from the back and abruptly slides off of the elevated cushion which acts as a wedge for sliding the user to his or her feet. For many users such an abrupt rise is simply not suitable and some lift and/or support is required under the thigh area of the user. Furthermore, the type of lifter seat described does not generally adapt to the anatomy of the user and may, in fact, be uncomfortable or not usable for particular individuals.

SUMMARY OF THE INVENTION

Accordingly, it is an object of the present invention to provide a new and improved inflatable seat cushion which enables the handicapped to move gently from a sitting into a standing position either under the control of the user or that of an assistant.

A further object of this invention is to provide a new and improved inflatable seat cushion which is small, lightweight and can be easily moved from one location to another in contrast to available recliner lift chairs.

Still another object of this invention is to provide a new and improved inflatable seat cushion which will enable a patient to stand from a sitting position in a bed thereby avoiding the need for an automatic bed with a vertical lift.

Another object of this invention is to provide a new and improved seat cushion which can be used on a wheelchair as a lifting aid.

Still another object of this invention is to provide a new and improved inflatable seat cushion which can be used in automobiles, trucks and the like thereby eliminating the need in many cases for expensive lifting-type devices for such vehicles.

Still another object of this invention is to provide a new and improved inflatable seat cushion which when an attendant is required, will save the attendant's effort in lifting the patient.

Another object of the present invention is to provide a new and improved inflatable seat cushion which, in contrast to recliner chairs, hospital beds or specially equipped cars, is relatively inexpensive and portable, and can be used for all of these purposes without specially modifying the cushion for a particular use.

In carrying out this invention in one illustrative embodiment thereof, an inflatable seat cushion is positioned on a firm support for assisting the user in rising from a seated position on the cushion. The cushion is made of a ring-shaped inflatable tube having a front area and a rear area and means for restricting the inflation of the front area of the tube with with respect to the rear area. The ratio of inflation between the rear and front areas is in the range of approximately three to seven times. Control means are provided under the control of the user for inflating the inflatable seat cushion whereby the thighs of the user are supported and elevated on the inflation in the front area while the user's buttocks seated in the cushion is elevated 3–7 times higher than the user's thighs thereby raising the user slowly from a sitting to a standing position in front of the support in which the cushion is positioned.

In one form, the ring-shaped inflatable tube means comprises a pair of inner connected inner tubes which are inflatable simultaneously with the front area being restricted by suitable means and in another embodiment, a single inflatable tube having a wedge-shaped configuration is provided. In either embodiment, a removable cover may be provided for restricting the inflated tube.

BRIEF DESCRIPTION OF THE DRAWINGS

The invention, together with further objects, aspects, features and advantages thereof, may be more clearly understood from the following description taken in conjunction with the accompanying drawings.

DESCRIPTION OF THE PREFERRED EMBODIMENTS

Figure 1:
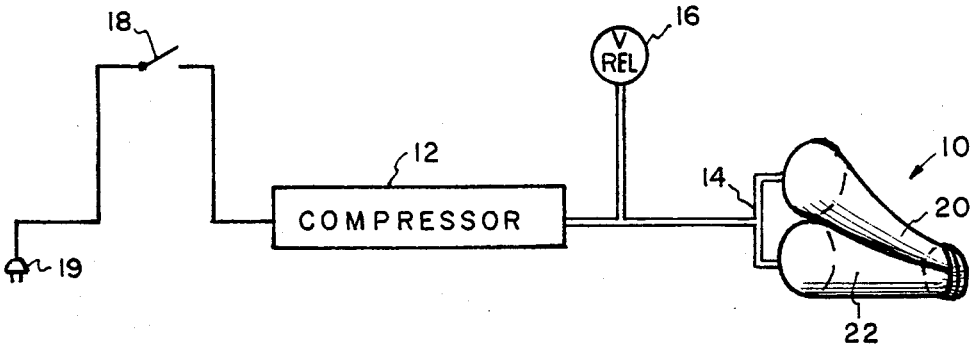
FIG. 1 is a schematic diagram of the new and improved inflatable seat cushion apparatus in accordance with the present invention.

Referring now to FIG. 1, an inflatable seat cushion or pillow, referred to generally with the reference numeral 10, is adapted to be inflated by a compressor 12 through a T-shaped feed valve 14. A relief valve 16 is provided for preventing over inflation of the cushion or pillow 10 as well as providing a means for deflating the inflatable cushion. The compressor 12 is operated through an ON/OFF switch 18 having an electrical plug 19 which fits into a conventional electrical outlet.

Figure 3:
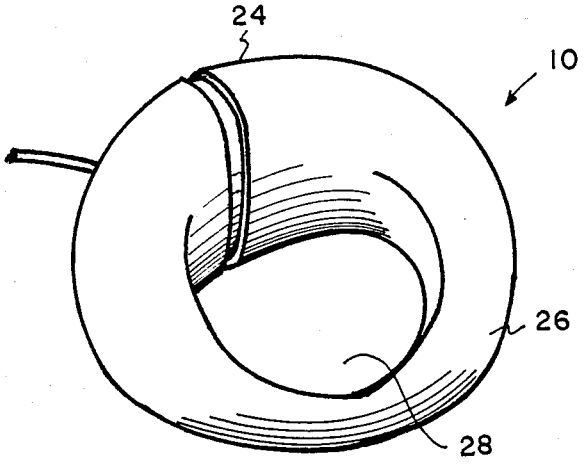
FIG. 3 illustrates the inflatable seat cushion of FIG. 2 having a removable cover positioned thereon.
Figure 2:
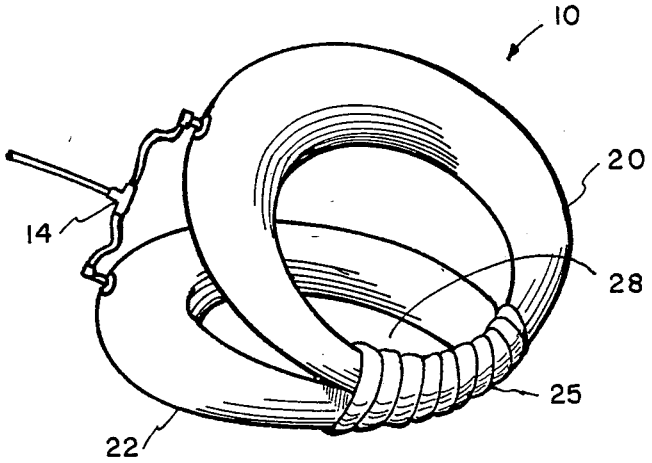
FIG. 2 illustrates one embodiment of the inflatable seat cushion employing a double inner tube with a common inflation means.

One form of the inflatable seat cushion or pillow lo is illustrated in FIG. 2 in the form of a pair of inner tubes 20 and 22 which have a restrictive means 25 thereon in the form of a strap or band of any suitable material for restricting the inflation of the front area of the tube means 20 and 22. A wedge-shaped arrangement is provided for the seat cushion or pillow 10 when it is inflated. The T-shaped feed valve 14 connects to both inner tubes 20 and 22 for the simultaneous inflation of the seat cushion or pillow 10. As will be seen in FIG. 3, a removable cover 24 may be provided as a shape-conforming guide for the inflatable seat cushion 10. The cover 24 is much smaller in the front area 26 thereon and considerably larger in the rear area, thus again presenting a wedge-shaped hollow pillow-type seat cushion. The particular shapes of the ring-shaped inflatable tubes 20 and 22 of appropriate size and configuration provide support on both sides of a patient's buttocks seated thereon in providing greater stability and balance. The two inner tubes 20 and 22 positioned one on top of the other, provide excellent support with each tube being allowed to expand in a predetermined wedge shape as determined by the restrictive means 25 and/or in combination with the enclosure 26 as shown in FIG. 3.

In operation, the patient or user is seated on the inflatable seat cushion 10 with the front portion or area 26 of the seat cushion 10 being positioned under the thighs of the user near the knees while the patient's buttocks is positioned in the larger area 28 of the inner tubes 20 and 22. As will be seen in FIG. 1, the plug 19 is plugged into a suitable electrical outlet and the switch 18 is closed operating the compressor 22 to apply air through the feed valve 14 into the inner tubes 20 and 22. The inflatable cushion is on a firm support and the patient is seated on that cushion on the support from which the user wishes to rise. As the inflatable pillowed seat cushion 10 is inflated, both inner tubes 20 and 22 are inflated simultaneously and due to the restrictive means 25 on the front area of the cushion 10, the front area is allowed to expand from two to six inches in height, depending on the size of the patient, while the area on which the patient is sitting will be allowed to rise twelve to about fifteen inches. Accordingly, the inflation of the area between the rear and the front of the cushion is in a range of between three to seven times greater in the amount of expansion. The intermediate portions between the front and rear areas will taper sharply in each direction. By restricting the front area of the pillow as the pillow seat cushion 10 is inflated, the patient will be elevated both in front and rear with a smaller portion of elevation being in the front which provides a support under the thighs of the patient in a gradual fashion while the rear end of the patient is elevated allowing the patient to be gently elevated and moved forward to a nearly standing position out of the seat cushion, thus permitting the patient or user to complete the standing position.

The pressure for inflating the cushion 10 (even for heavy patients) will require only a few pounds per square inch and with an air inlet from the T-shaped feed valve 14 being in the order of a quarter of an inch in inside diameter requires only a third of a horsepower compressor having a weight of four to five pounds and can inflate the cushion 10 and lift the patient gently into a standing position within ten to twenty five seconds. The relief valve will prevent over expansion of the pillow and a safety switch (not shown) may be used to cut off the electricity to the compressor 12 when the inflatable seat cushion has expanded to a set height.

Figure 4:
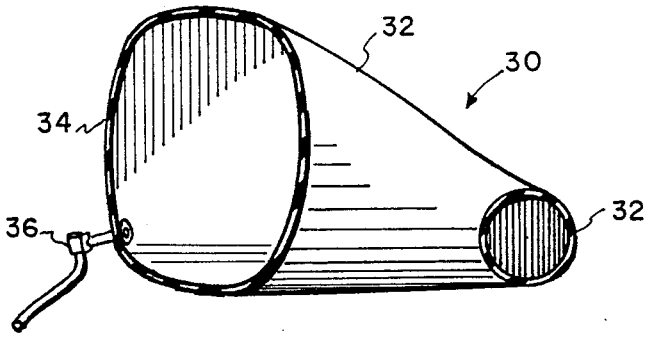
FIG. 4 is a cross-sectional view of a wedge-shaped, inflatable seat cushion formed in a single tube.
Figure 5:
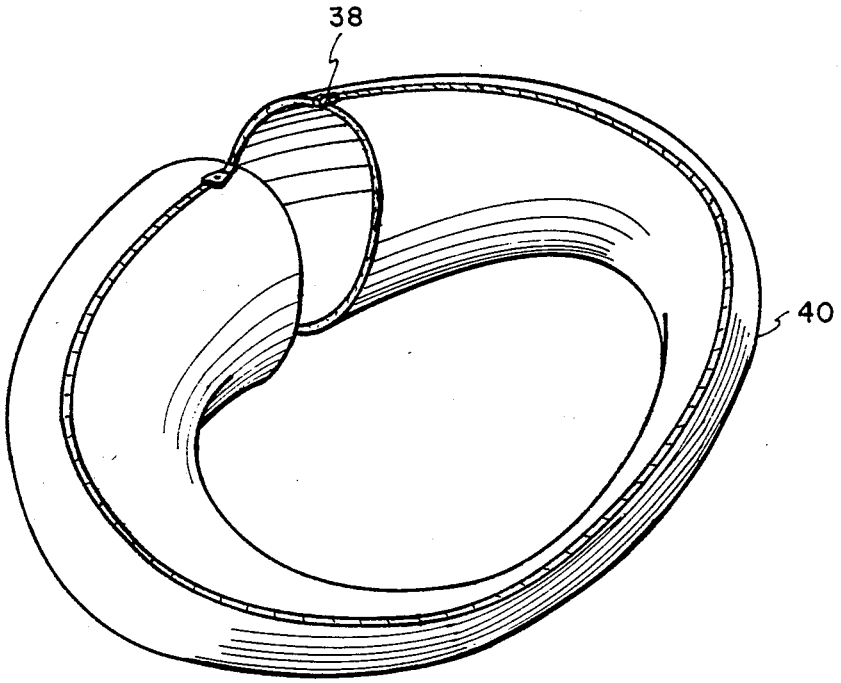
FIG. 5 illustrates a removable cover which may be used in either of the embodiments of FIGS. 2 and 4 thereby providing a removable cover for the inflatable seat cushion in accordance with the present invention.

The seat cushion 10 can remain inflated until the user wishes to sit down at which point the user simply positions him or herself on top of the inflated seat cushion 10 and opens the relief valve 16 while sitting down. The air slowly escapes and the user is gently moved back into a sitting position. As will be seen in FIG. 4, instead of using a two inner tube combination in accordance with the embodiment shown in FIG. 2, a single ring-shaped inflatable tube 30 which has a restricted configuration 32 on the front area thereof with tapered side walls 32 leading to a much larger rear area 34 thereon and utilizing a single feed end valve 36 may be used. The single tube embodiment as illustrated in FIG. 4 again has a wedge-shaped hollow configuration but simply has one tube instead of two. A removable cover 40 having a zipper 38 thereon may be provide for enclosing the inflatable seat cushion 30 to provide both shape configuration as well as a means for removal and washing of the cover for sanitary purposes. The operation of the device is the same with the restricted front area being inflatable a fraction of the rear area 34 with the inflation of the rear area 34 being three to seven times larger than the inflated front area 32 of the pillow seat cushion 30.

In providing a hollow ring pillow inflated type configuration, the user is elevated slowly with support being provided not only in the user's rear but also under his/her thighs so that the weight is shifted down on the legs so that some support is provided for the thigh muscles prior to receiving the full weight of the body. This gives the patient's leg muscles time to adjust to gradually receive the weight of the patient instead of having all the patient weight immediately dumped on those legs.

The inflatable seat cushion is relatively inexpensive as compared to recliner lift type chairs or other lifts and mechanical devices which aid people in getting to their feet. The cushion may be used on wheelchairs as well as regular chairs and on seats in passenger vehicles for aiding a person in getting both out and in a vehicle. Even if the patient is so infirm as to be unable to operate the device, nevertheless, it is useful for an assistant who does not have to pick the patient up in aiding that patient to rise. The device is also considerably cheaper than most mechanical appliances which are now utilized for lifting and moving patients.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. An inflatable seat cushion positioned on a firm support on which a user is seated for assisting the user in rising from a seated position on the cushion, comprising:

a ring-shaped inflatable tube means having a front area and rear area;

means for restricting the inflation of the front area of said tube means with respect to said rear area of said tube means, the ratio of inflation between the rear to front areas being in the range of 3 to 7 times greater.

control means under the control of the user for inflating said inflatable seat cushion whereby the thighs of the user are supported and slowly elevated on the inflation of the front area while the user's buttocks seated in the cushion is simultaneously elevated higher than the user's thighs thereby raising the user slowly from a sitting to a standing position in front of the support on which the cushion is positioned.

2. The inflatable seat cushion as claimed in claim 1 wherein said tube means comprises a pair of inner tubes positioned one on top of the other and having a common feed means.

3. The inflatable seat cushion as claimed in claim 2 wherein said common feed means comprises a T-shaped feed valve.

4. The inflatable seat cushion as claimed in claim 1 wherein said control means includes a compressor coupled to said inflatable tube means, a relief valve coupled between said compressor and said tube means for controlling the amount of inflation of said tube means and an electrical switch for applying power to said compressor.

5. The inflatable seat cushion as claimed in claim 1 wherein said tube means comprises a single wedge-shaped tube.

6. The inflatable seat cushion as claimed in claim 5 having a removable cover with same wedge-shaped configuration as the inflated wedge-shaped tube.

7. The inflatable seat cushion as claimed in claim 1 having a removable cover which aids in configuring the inflated shape of the seat cushion.

* * * * *